US009605847B2

(12) United States Patent
Wright

(10) Patent No.: US 9,605,847 B2
(45) Date of Patent: Mar. 28, 2017

(54) SOOT TRAP FOR USE IN CHIMNEY CLEANING

(71) Applicant: John W Wright, Horsefly (CA)

(72) Inventor: John W Wright, Horsefly (CA)

( * ) Notice: Subject to any disclaimer, the term of this patent is extended or adjusted under 35 U.S.C. 154(b) by 0 days.

(21) Appl. No.: 15/005,391

(22) Filed: Jan. 25, 2016

(65) Prior Publication Data

US 2016/0377284 A1 Dec. 29, 2016

(30) Foreign Application Priority Data

Jun. 29, 2015 (CA) ..... 2895596

(51) Int. Cl.
*F23J 3/02* (2006.01)

(52) U.S. Cl.
CPC ..... *F23J 3/026* (2013.01)

(58) Field of Classification Search
CPC ..... F23J 3/02; F23J 3/026; F23J 3/04; B08B 9/023
See application file for complete search history.

(56) References Cited

U.S. PATENT DOCUMENTS 1,758,950 A * 5/1930 Hunecke ..... F23J 3/026 15/104.069
2,275,320 A * 3/1942 Savicki ..... F28G 1/166 15/104.066
5,881,420 A * 3/1999 Bruckelmyer ..... F23J 3/026 138/89
2007/0256839 A1* 11/2007 Moynahan ..... B08B 9/023 166/312

FOREIGN PATENT DOCUMENTS

CA 2467179 A1 11/2005

* cited by examiner

*Primary Examiner* — Randall Chin
(74) *Attorney, Agent, or Firm* — Davis & Bujold PLLC; Michael J. Bujold

(57) ABSTRACT

A soot trap for use in chimney cleaning which includes a soot trap housing having a bottom, a circumferential sidewall, and a top which together define an interior cavity. The bottom and the top have axially aligned push rod pass through openings. A closure is provided in one of the top or the bottom to provide access to the interior cavity of the housing. A sequential series of push rod wipers is stacked loosely in the interior cavity of the housing. Each push rod wiper has an opening that is in axial alignment with the push rod pass through openings, such that the sequential series of push rod wipers wipe soot into the interior cavity of the housing as a push rod passes through the push rod pass through openings.

8 Claims, 2 Drawing Sheets

SOOT TRAP FOR USE IN CHIMNEY CLEANING

FIELD

There is described a soot trap which prevents soot from being drawn into a residence when cleaning a chimney from inside of a residence.

BACKGROUND

Canadian Patent 2,467,179 (Foster) entitled "Soot Collector For Cleaning Ceiling Installed Prefabricated Chimneys" describes a tool for cleaning a chimney from inside a residence. The soot collector consists of a container that is secured on the bottom of a chimney. The container has a central bore to allow passage of a chimney cleaning device.

SUMMARY

There is provided a soot trap for use in chimney cleaning which includes a soot trap housing having a bottom, a circumferential sidewall, and a top which together define an interior cavity. The bottom and the top have axially aligned push rod pass through openings. A closure is provided in one of the top or the bottom to provide access to the interior cavity of the housing. A sequential series of push rod wipers is stacked loosely in the interior cavity of the housing. Each push rod wiper has an opening that is in axial alignment with the push rod pass through openings, such that the sequential series of push rod wipers wipe soot into the interior cavity of the housing as a push rod passes through the push rod pass through openings.

The soot trap, as described, is intended to collect soot from the push rod, so soot is confined within the interior cavity of the housing.

Although beneficial results may be obtained from the soot trap, as described above, is it preferred that the opening in each push rod wiper have resilient flaps that move in response to contact and then resiliently return. This allows the opening to expand as required to allow passage of couplings that connect push rods in end to end relation and then retract around the push rods. The longer the chimney the more connections there must be between push rods. If the opening does not expand and contract, it would have to be large enough to accommodate the couplings connecting the push rods. This would make it more difficult to confine soot within the housing.

Although beneficial results may be obtained from the soot trap, as described above, it is preferred that a resident push rod extends through the axially aligned push rod pass through openings in the housing and through the opening in the sequential series of push rod wipers stacked loosely in the interior cavity of the housing. The resident push rod has an upper end and a lower end. The upper end has a coupling for connecting with cleaning brushes. The lower end has a coupling for connecting to a string of push rods. Removal of the last push rod poses the greatest risk of pulling soot into the residence. This risk is eliminated when the last push rod is a resident push rod that is not intended to be removed. Preferably, a stop is positioned at the upper end of the resident push rod. This stop engages the top of the housing to limit downward movement of the resident push rod. It will be understood that the resident push rod is freely movable upwardly away from the top of the housing.

Although beneficial results may be obtained from the soot trap, as described above, it is preferred that an overlying seal rests on the top of the housing to limit entry of soot into the housing. This overlying seal results in less soot entering the housing.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

Figure 1:
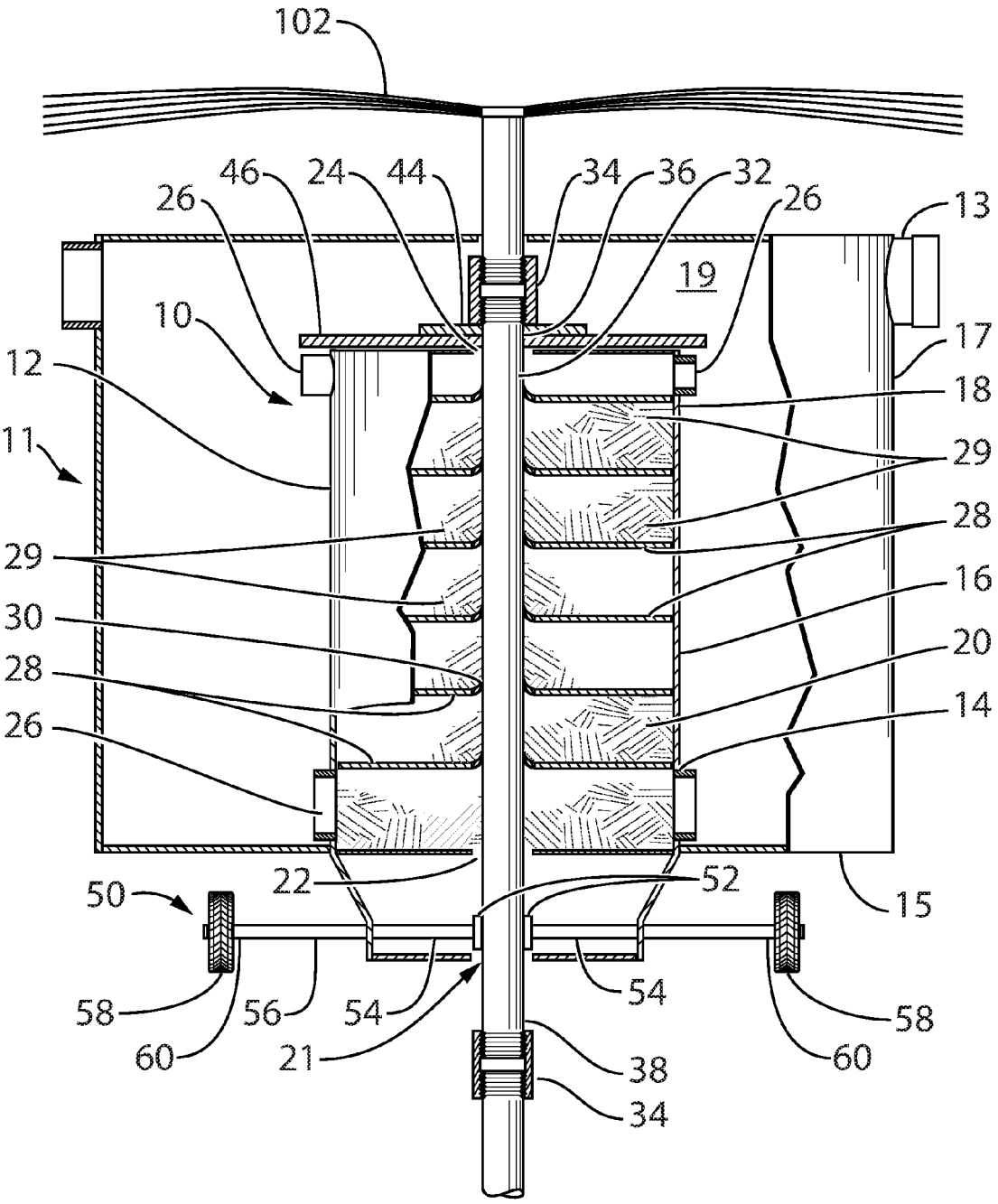
FIG. 1 is a side elevation view, in section, of a soot trap.

A soot trap, generally identified by reference numeral 10, will now be described with reference to FIG. 1 and FIG. 2.

Structure and Relationship of Parts:

Referring to FIG. 1, soot trap 10 includes a soot trap housing 12 which is positioned within a soot collection vessel 11. Soot collection vessel 11 is connected to a chimney (not shown) by a clamping band 13. Soot collection vessel 11 has a bottom 15 and circumferential sidewall 17 defining an interior cavity 19. Bottom 15 has a port 21 through which push rods 32 pass. Soot trap 10 is intended to prevent soot which accumulates with in interior cavity 19 of soot collection vessel 11 from passing through port 21 as push rods 32 pass through port 21. Soot trap has a bottom end 14, a circumferential sidewall 16, and a top end 18 which together define an interior cavity 20. A closure 26 is provided at bottom 14 to provide access to interior cavity 20 of housing 12. In the illustrated embodiment, closure 26 has been illustrated as being secured to bottom 15 within interior cavity 19 of soot collection vessel 11. Closure 26 at bottom end 14 and top end 18 of soot trap 10 have axially aligned push rod pass through openings 22 and 24, respectively. Push rod pass through opening 22 in closure 26 is in axial alignment with port 21 in bottom 15 of soot collection vessel 11. A sequential series of push rod wipers 28 are stacked loosely in interior cavity 20 of housing 12. Each push rod wiper 28 has an opening 30 that is in axial alignment with push rod pass through openings 22 and 24. Sequential series of push rod wipers 28 wiper soot from push rod 32 passing through push rod pass through openings 22 and 24. Positioned between push rod wipers 28 is a soot collection medium 29. Soot collects in soot collection media 29.

Figure 2:
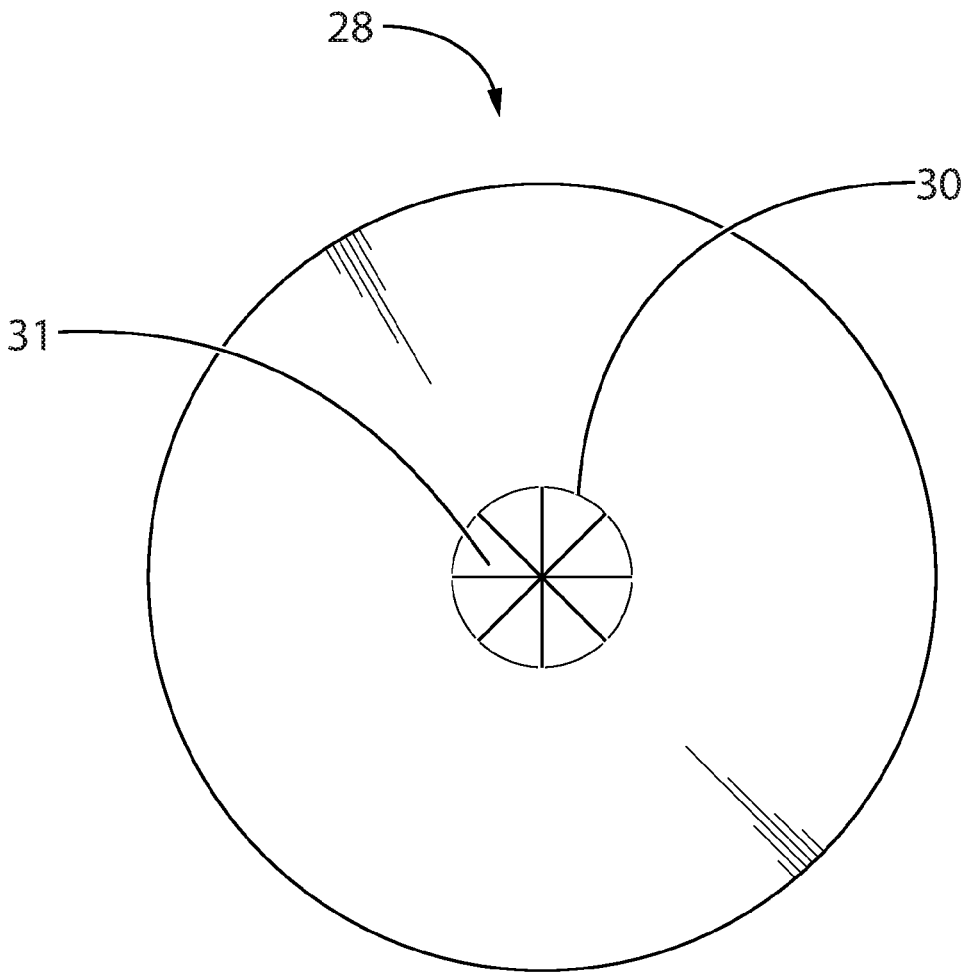
FIG. 2 is a detailed top plan view of a soot collector from the soot trap illustrated in FIG. 1.

Referring to FIG. 2, opening 30 in each push rod wiper 28 has resilient flaps 31 that move in response to contact and then resiliently return. This allows opening 30 to expand as required to allow passage of couplings 34 that connect push rods 32 in end to end relation and then retract around push rods 32. Resilient flaps 31 can best be described as pieces that are analogous to sectors of a circle created when one cuts a pie. The longer the chimney the more push rods 32 must be used. At each connection between push rods 32, a mating coupling 34 is used having a male to female connection. If opening 30 did not expand and contract, it would have to be large enough to accommodate couplings 34 connecting push rods 32. This would make it more difficult to confine soot within housing 12. Push rod wipers 28 have been made in the form of disks that fit into housing 12 that is cylindrical. Push rod wipers 28 were originally made from leather in proto-types, but could also be made from a synthetic material. Referring to FIG. 1, plastic string pot scrubbers were originally used as soot collection media 29 in proto-types. The pot scrubbers served as spacers which accommodated movement of push rod wipers 28. The pot scrubbers were thought to also serve a cleaning function while leaving ample space for the accumulation of soot. The multiple layers of push rod wipers 28 meant that there was little chance of soot passing through housing 12. It will be understood that the use of soot collection media 29 is not absolutely essential, for soot will become trapped within interior cavity 20 of housing 12 even without the use of soot collection media 29.

Referring to FIG. 1, push rod 32, as illustrated, is a "resident" push rod. Push rod 32 extends through the axially aligned push rod pass through openings 22 and 24 in housing 12 and through opening 30 in the sequential series of push rod wipers 28 stacked loosely within interior cavity 20 of housing 12. Resident push rod 32 has an upper end 36 and a lower end 38. Coupling 34 at upper end 36 is used for connecting with cleaning brushes 102. Coupling 34 at lower end 38 is used for connecting push rod 32 to a string of push rods (not shown). The reason that push rod 32 is termed a "resident" push rod is that push rod 32 is not intended to be removed from bottom end 14 of housing 12. A stop 44 is positioned at upper end 36 of resident push rod 32. Stop 44 engages top 18 of housing 12 to limit downward movement of push rod 32. It will be understood that push rod 32 is freely movable upwardly away from top 18 of housing 12.

An overlying seal 46 rests on top 18 of housing 12 to limit entry of soot into housing 12. Use of overlying seal 46 results in less soot entering housing 12 and, therefore, cuts down on the amount of soot to be wiped by push rod wipers 28 and collected in soot collection media 29.

When adding or removing a push rod 23 to the string of push rods (not shown), there is a danger that the string of push rods may become separated at a location other than the one intended. When such a separation accidently occurred, an additional feature was added to soot trap 10 and soot collection vessel 11. There is now provided a screw clamp, generally identified by reference numeral 50. Screw clamp 50 has two clamping pads 52. Clamping pads 52 that can be selectively brought into engagement with push rod 32. Clamping pads 52 are mounted at a first end 54 of threaded rods 56. Gripping disks 58 are positioned at a second end 60 of threaded rods 56. When a user turns gripping disks 58 threaded rods 56 rotate and move clamping pads into or out of engagement with push rods 32. Out of an abundance of caution screw clamp 50 is used whenever adding or removing a push rod 32 from the string of push rods (not shown). With screw clamp 50 engaged there is no risk of a connection above soot trap 10 being inadvertently disengaged.

Operation:

Referring to FIG. 1, seal assembly and soot trap 10 is installed in soot collection vessel 11. Coupling 34 at upper end 36 of resident push rod 32 is connected to cleaning brush 102. Soot collection vessel 1 is secured to a bottom of a chimney (not shown) by clamping strap 13. Coupling 34 at lower end 38 of resident push rod 32 is then secured to string of push rods (not shown). As an upward force is exerted upon the string of push rods, push rod 32 passes through axially aligned push rod pass through openings 22 and 24, in bottom end 14 and top end 18 and moves upwardly away from top end 18 of housing 12. As push rod 32 passes through opening 30 in push rod wipers 28, resilient flaps 31 move in response to contact from each coupling 34 and then resiliently return to engage one of push rods 32 of the string of push rods.

As cleaning occurs, cleaning brush 102 knocks soot from the chimney. The soot falls into soot collection vessel 11. When cleaning of the chimney is completed, the string of push rods is pulled back through housing 12. Overlying seal 46 serves as a wiper seal to limit entry of soot into housing 12. However, some soot will cling to the string of push rods. Resilient flaps 31 positioned in opening 30 of each push rod wiper 28 will move in response to contact from each coupling 34 as each coupling 34 is pulled through opening 30 and then resilient flaps 31 will resiliently return to again engage the string of push rods. As a result of the sliding contact with the stack of push rod wipers, soot is sequentially wiped from the string of push rods and collects in the soot collection media 29 within housing 12. Stop 44 at upper end 36 of resident push rod 32 engages top 18 of housing 12 to limit downward movement of resident push rod 32 and prevent resident push rod 32 from being withdrawn. Collection vessel 11 is then removed from the chimney with seal assembly and soot trap 10 still attached and taken out of the residence. After removal of cleaning brush 102, soot collection vessel 11 is dumped and the soot disposed of. Seal assembly and soot trap 10 can then be removed from soot collection vessel 11 and closure 26 opened to facilitate dumping of housing 12 along with inspection and cleaning of push rod wipers 28 and soot collection media 29.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The illustrated embodiments have been set forth only as examples and should not be taken as limiting a purposive interpretation of the claims.

What is claimed is:

1. A soot trap for use in chimney cleaning, comprising:

a soot trap housing having a bottom, a circumferential sidewall, and a top which together define an interior cavity, the bottom and the top having axially aligned push rod pass through openings, a closure being provided in one of the top or the bottom to provide access to the interior cavity of the housing; and a sequential series of push rod wipers stacked loosely in the interior cavity of the housing, each push rod wiper having an opening that is in axial alignment with the push rod pass through openings, the sequential series of push rod wipers wiping soot into the interior cavity of the housing as a push rod passes from one of the push rod pass through openings at the top of the soot trap housing to another one of the push rods pass through openings at the bottom of the soot trap housing.

2. The soot trap of claim 1, wherein the push rod is one of a string of push rods connected in end to end relation with push rod couplings, the opening in each push rod wiper has resilient flaps that move in response to contact from the push rod coupling to enlarge the opening in each push rod wiper as the push rod coupling is pulled through the opening and then resiliently return, thereby allowing the opening to expand as required to allow passage of the push rod couplings with the resilient flaps then resiliently returning to contract the opening in each push rod wiper around the string of push rods.

3. The soot trap of claim 2, wherein the flaps define sectors of a circle.

4. The soot trap of claim 2, wherein the string of push rods includes a resident push rod extends through the axially aligned push rod pass through openings in the housing and through the opening in the sequential series of push rod wipers stacked loosely in the interior cavity of the housing, the resident push rod having an upper end and a lower end, the upper end having a coupling for connecting with cleaning brushes and the lower end having a coupling for connecting to the string of push rods.

5. The soot trap of claim 4, wherein a stop is positioned at the upper end of the resident push rod, the stop engaging the top of the housing to limit downward movement of the resident push rod, the resident push rod being freely movable upwardly away from the top of the housing.

6. The soot trap of claim 1, wherein an overlying seal rests on the top of the housing to limit entry of soot into the housing.

7. The soot trap of claim 1, wherein soot collection media is positioned within the housing.

8. The soot trap of claim 1, wherein a push rod clamp is positioned under the housing, the push rod clamp having clamping pads that are selectively moveable into and out of engagement with the push rod.

* * * * *